United States Patent [19]

Okuno et al.

[11] Patent Number: 4,696,589

[45] Date of Patent: Sep. 29, 1987

[54] INK-DOT PRINTER

[75] Inventors: Shigeru Okuno; Yoshihiro Torisawa, both of Mishima; Mitsuharu Endo, Susono; Tetsuroh Nakayama, Mishima; Masashi Shimosato, Shizuoka; Takafumi Fukushima, Fuji, all of Japan

[73] Assignee: Tokyo Electric Co., Ltd., Tokyo, Japan

[21] Appl. No.: 789,618

[22] Filed: Oct. 21, 1985

[30] Foreign Application Priority Data

Oct. 26, 1984 [JP] Japan ..... 59-225531
Nov. 6, 1984 [JP] Japan ..... 59-233946

[51] Int. Cl.[4] ..... B41J 3/12; B41J 27/19

[52] U.S. Cl. ..... 400/119; 400/124; 400/470; 101/93.05; 346/140 R

[58] Field of Search ..... 400/124, 72, 121, 470, 400/118, 119; 101/93.05, 93.04; 346/140

[56] References Cited

U.S. PATENT DOCUMENTS 4,552,472 11/1985 Tsuge et al. ..... 400/470 X
4,553,865 11/1985 Ikeda et al. ..... 400/470 X

FOREIGN PATENT DOCUMENTS 59-42972 3/1984 Japan .
59-49165 3/1984 Japan .
152874 8/1984 Japan ..... 400/470
155059 9/1984 Japan ..... 400/470
155060 9/1984 Japan ..... 400/470
155061 9/1984 Japan ..... 400/470
188448 10/1984 Japan ..... 400/470
229352 12/1984 Japan ..... 400/124
2379 1/1985 Japan ..... 400/124

*Primary Examiner*—Charles A. Pearson
*Assistant Examiner*—James R. McDaniel
*Attorney, Agent, or Firm*—Frishauf, Holtz, Goodman & Woodward

[57] ABSTRACT

An ink-dot printer comprises a pair of slit forming members arranged to define a slit therebetween, an ink tank for storing ink in which the slit is immersed, a recording sheet opposed to the slit, a needle movable between a rest position and a projected position, a driving mechanism for moving the needle between the two positions, and an ink attracting unit for generating a magnetic or electric field in the slit, thereby attracting the ink from the ink tank into the slit to cause the ink to attach to the distal end portion of the needle located in the rest position, the ink attracting unit being adapted to generate an ink attracting magnetic or electric force of a necessary intensity for the ink to be attracted from the ink tank into the slit at the time of ink attraction, and to generate an ink holding magnetic or electric field of a minimum necessary intensity for a predetermined amount of ink to be held in the slit after the predetermined amount of ink is attracted into the slit, wherein the ink attaching to the distal end portion at the rest position is moved to the recording sheet to form an ink dot thereon as the needle moves to approach the recording sheet in a projected position.

3 Claims, 10 Drawing Figures

INK-DOT PRINTER

BACKGROUND OF THE INVENTION

The present invention relates to an ink-dot printer which comprises a pair of slit forming members arranged so as to define a slit therebetween, ink storage means for storing ink so that the slit between the two slit forming member is immersed in the ink, a recording medium opposed to the slit, a needle movable between a rest position in which the distal end portion of the needle facing the recording medium is located in the slit and a projected position in which the distal end portion is projected from the slit to be located closer to the recording medium than in the rest position, driving means for moving the needle between the rest position and the projected position, and ink attracting means for generating a magnetic or electric field in the slit between the two slit forming members, thereby attracting the ink from the ink storage means into the slit to cause the ink to attach to the distal end portion of the needle located in the rest position, so that the ink is moved to the recording medium to form an ink dot thereon as the needle attaching the ink on the distal end portion thereof in the rest position moves to approach the recording medium in the projected position.

In the prior art ink-dot printers with the construction described above, if a magnetic field is to be produced to attract the ink into the slit between the slit forming members, the slit forming members are coupled to an electromagnet, and magnetic ink is used for the ink.

In the conventional printers of this type, moreover, if an electric field is to be produced to attract the ink into the slit between the slit forming members, the slit forming members are connected to a power source, and oil ink is used for the ink.

In these conventional ink-dot printers, electric power comsumption required for the production of an ink attracting magnetic or electric field having such strength that is needed to attract the ink until a predetermined amount of ink (enough for the distal end portion of the needle in the slit to be immersed therein) is attracted from the ink storage means (usually an ink tank) into the slit is much higher than that for the production of an ink holding magnetic or electric field having such strength that is needed to keep the predetermined amount of ink in the slit.

In the prior art ink-dot printers, however, in ink attracting means keeps on producing a constant magnetic or electric field in the slit between the slit forming members during the time lapse which elapses from the instant that the ink starts to be attracted from the ink storage means into the slit until the ink in the slit starts to be returned to the ink storage means. Since the constant magnetic or electric field is the ink attracting magnetic or electric field, these prior art ink-dot printers require high power consumption.

SUMMARY OF THE INVENTION

The present invention is contrived in consideration of these circumstances, and is intended to provide an ink-dot printer permitting a reduction in power consumption.

The above object of the present invention is achieved by an ink-dot printer which comprises a pair of slit forming members arranged so as to define a slit therebetween, ink storage means for storing ink so that the slit between the two slit forming members is immersed in the ink, a recording medium opposed to the slit, a needle movable between a rest position in which the distal end portion of the needle facing the recording medium is located in the slit and a projected position in which the distal end portion is projected from the slit to be located closer to the recording medium than in the rest position, driving means for moving the needle between the rest position and the projected position, and ink attracting means for generating a magnetic or electric field in the slit between the two slit forming members, thereby attracting the ink from the ink storage means into the slit to cause the ink to attach to the distal end portion of the needle located in the rest position, the ink attracting means being adapted to generate an ink attracting magnetic or electric field of a necessary intensity for the ink to be attracted from the ink storage means into the slit at the time of ink attraction, and to generate an ink holding magnetic or electric field of a lower intensity for a predetermined amount of ink to be held in the slit after the predetermined amount of ink is attracted into the slit, wherein the ink attaching to the distal end portion of the needle at the rest position is moved to the recording medium to form an ink dot thereon as the needle moves to approach the recording medium in its projected position.

More specifically, the ink attracting means for drawing the ink from the ink storage means into the slit between the pair of slit forming members by the magnetic or electric field is adapted to generate an ink attracting magnetic or electric field of a necessary intensity for the ink to be attracted from the ink storage means into the slit at the time of ink attraction, and to generate a lower ink holding magnetic or electric field of a minimum necessary intensity for a predetermined amount of ink to be held in the slit after the predetermined amount of ink is attracted into the slit, so that the power comsumption of the ink-dot printer may be reduced.

If the ink remains in the slit without being returned to the ink storage means after the lapse of a relatively long time from the last use of the ink-dot printer, it will dry to increase its viscosity, thereby preventing or hardening the movement of the needle from the rest position to the projected position. Also it will be difficult or impossible for the dried ink in the slit to be returned to the ink storage means. As it is dried further, the high-viscosity ink remaining in the slit will cling to the inside of the slit, disabling the ink-dot printer.

In order to avoid these troubles, in the ink-dot printer of the present invention with the construction described above, the ink attracting means preferably ceases from generating the magnetic or electric field in the slit between the two slit forming members, to return the ink in the slit to the ink storage means after the lapse of a predetermined nonprinting time.

In the ink-dot printer with the aforementioned construction, moreover, if the ink is to be attracted from the ink storage means into the slit between the two slit forming members by generating the magnetic field in the slit, the ink attracting means preferably includes an electromagnet connected to the slit forming members and adapted to generate the magnetic field in the slit.

With this arrangement, a simple structure may be used as a means for generating a properly adjusted magnetic field.

The ink-dot printer according to the embodiment of the present invention and its modifications will now be described in detail with reference to the accompanying drawings.

DETAILED DESCRIPTION OF THE PREFERRED EMBODIMENTS

Figure 1:
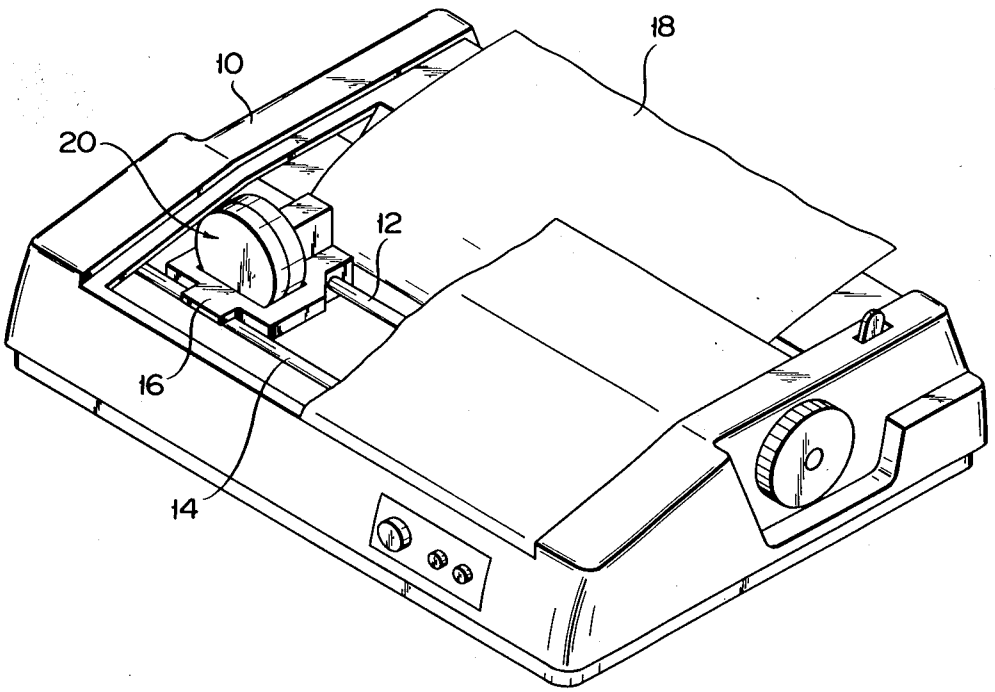
FIG. 1 is a cutaway perspective view of an ink-dot printer according to an embodiment of the present invention.

In an ink-dot printer according to an embodiment of the present invention shown in FIG. 1, a carriage shaft 12 and a guide shaft 14 are arranged parallel to each other in a housing 10. A carriage 16 is mounted on the carriage shaft 12 and the guide shaft 14 for reciprocation. The carriage 16 carried thereon a printing head 20 which faces a recording sheet 18 as a recording medium.

Figure 2:
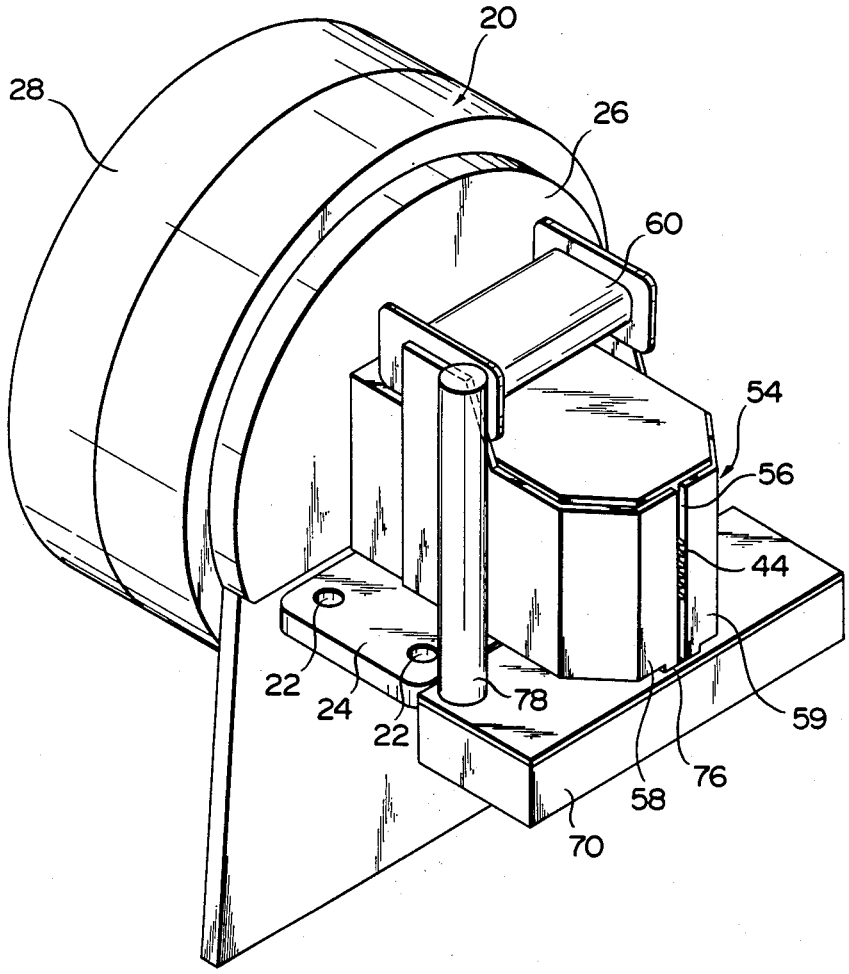
FIG. 2 is an enlarged perspective view showing a printing head of the ink-dot printer of FIG. 1.

As best seen from FIG. 2, the printing head 20 is provided with a head mounting member 24 having bolt holes 22 in which bolts are inserted to fix the head 20 on the carriage 16. The head mounting member 24 is fitted with a head cover 26. The head cover 26, which is formed of a synthetic resin, accomodates needle driving means 30 in its circular rear portion 28, as shown in FIG. 3.

Figure 3:
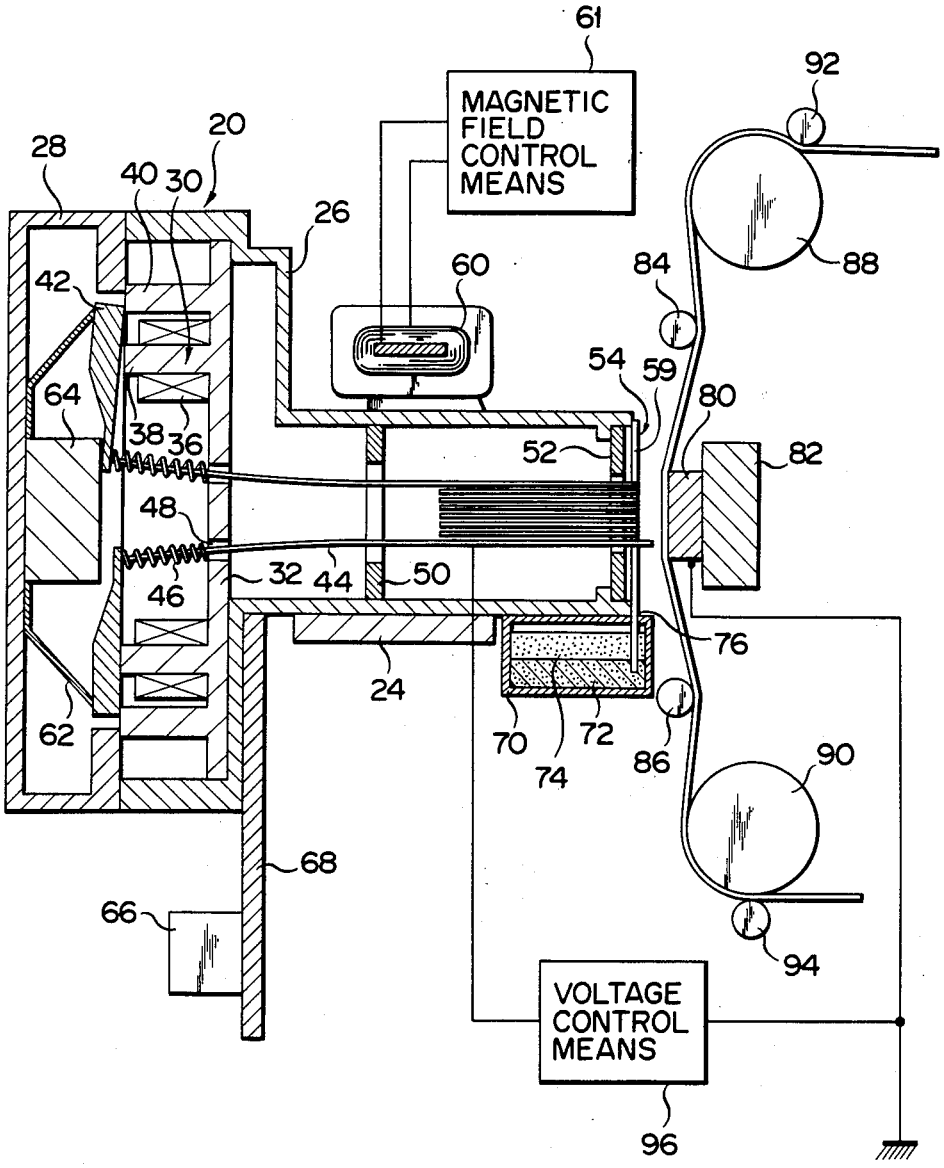
FIG. 3 is a vertical sectional view schematically showing the printing head, a recorded medium facing the head, and peripheral mechanisms around the recording medium of the ink-dot printer of FIG. 1.
Figure 4:
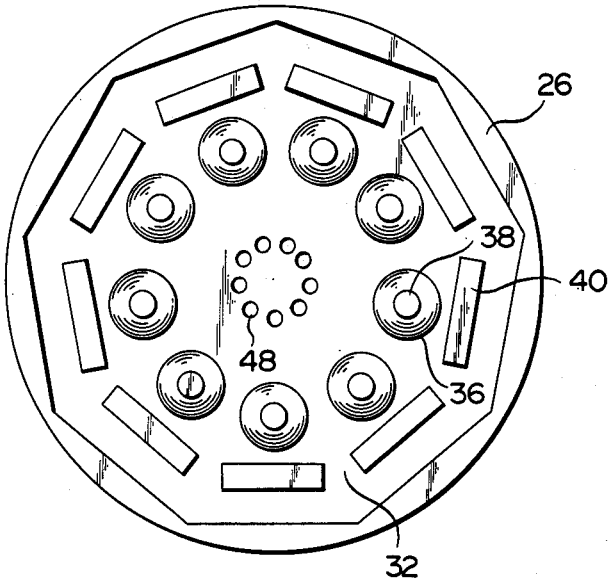
FIG. 4 is a rear view showing a magnetic member including cores and coils constituting electromagnets of needle driving means of the printing head of FIG. 3.

As shown in FIG. 3, the needle driving means 30 includes a magnetic member 34 which, formed of a magnetic material, has a flat partition wall 32 attached to a stepped portion of the head cover 26. As shown in FIGS. 3 and 4, a plurality of cores 38 each wound with a coil 36 are formed in a circular arrangement on the partition wall 32. Yokes 40 are arranged radially outside the cores 38 in a corresponding manner.

As shown in FIG. 3, each yoke 40 is rotatably fitted with the basal part of an armature 42 which faces each corresponding core 38. The proximal end of a needle 44 is fixed to the distal end portion of each armature 42 with the aid of electrical insulating means for preventing defective electrical insulation between the armature 42 and the needle 44. In this embodiment, a needle mounting portion at the distal end of the armature 42 is formed of an electrical insulating material, and the needles 44, which are nine in number, are made of an electrically conductive, nonmagnetic material, e.g., stainless steel, and have a diameter of approximately 0.2 mm. As shown in FIG. 3, a needle spring 46 is wound around each needle 44 between the partition wall 32 of the needle driving means 30 and each corresponding armature 42. The armatures 42, along with the needles 44, are urged rearward (to the left of FIG. 3) from the head cover 26 by the needle springs 46. The needles 44 penetrate aperatures 48 formed in a circular arrangement on the partition wall 32 of the magnetic member 34, as shown in FIG. 4, so that their distal ends reach ink film forming means 54 as ink supply means, guided by an intermediate guide 50 and an end guide 52 inside the head cover 26.

The ink film forming means 54 includes a pair of slit forming member 58 and 59 disposed parallel to each other so as to define a vertically extending slit 56, as shown in FIG. 2. In this embodiment, the slit forming members 58 and 59 are formed of magnetic plates. The rear end portions of the two slit forming members 58 and 59, which extend rearward along the two side faces of the head cover 26, are coupled to an electromagnet 60 located over the head cover 26 and constituting part of ink attracting means. The electromagnet 60 is connected to magnetic field control means 61 which controls the voltage supplied to the electromagnet 60, thereby controllng the intensity of a magnetic field which is produced in the slit 56 between the two slit forming members 58 and 59 by the electromagnet 60.

The circular portion 28 of the head cover 26, as shown in FIG. 3, further contains therein backup springs 62 for urging the armatures 42 in the returning direction and a stopper 64 for determining the return position of the armatures 42. The head cover 26 is fitted with a printed-wiring board 68 which has a connector 66 and is formed with an electric circuit (not shown) for controlling the electric supply to the coils 36 for the drive control of the needles 44. The electric circuit performs the control of the electric supply in response to needle drive signals from needle driving control means (not shown) which is electrically connected to the circuit by means of the connector 66. In this embodiment, the voltage applied to the coils 36 ranges from about 12 to about 13 volts.

The ink film forming means 54 further includes an plastic ink tank 70 which is attached to the bottom portion of the front end of the head cover 26 and constitutes ink storage means. The ink tank 70 contains an ink-impregnated material 72 and magnetic ink 74. The lower end portions of the two slit forming members 58 and 59 are inserted in a hole 76 bored through the top wall of the ink tank 70, and immersed in the magnetie ink 74. Thus, the slit 56 is also immersed in the magnetic ink 74. As shown in FIG. 2, an ink cartridge 78 for replenishing the ink tank 70 with the magnetic ink 74 is removably mounted on the top surface of the ink tank 70.

Inside the housing 10 of the ink-dot printer, as shown in FIG. 3, an electrode 80 serving also as a platen is held by an electrode holder 82 so as to face the printing head 20. In this embodiment, the electrode 80 is made of copper, and an electric insulating film of polyimide resin is formed on the contact surface of the electrode 80 to be in contact with the recording sheet 18. Both ends of the electrode 80 are supported on side plates (not shown) in the housing 10 by means of electric insulating members (not shown).

Paper backup guide rollers 84 and 86 are disposed above and below the electrode 80, respectively, whereby the recording sheet 18 is brought closely into contact with the electrode 80. A paper feed roller 88 and a paper tension roller 90 are arranged above the paper backup guide roller 84 and below the paper backup guide roller 86, respectively. A paper feed backup roller 92 and a paper backup roller 94 are paired with the paper feed roller 88 and the paper tension roller 90, respectively.

Figure 5:
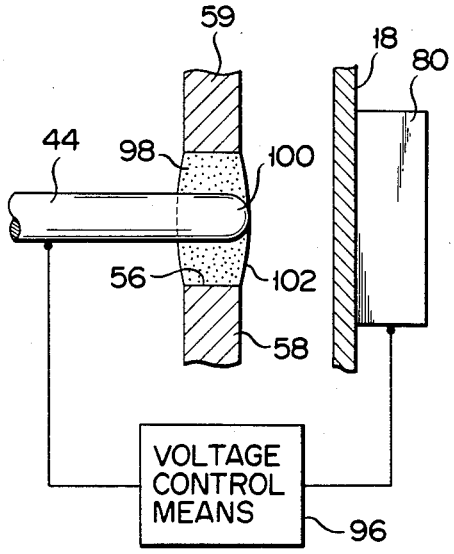
FIG. 5 is a sectional plan view schematically showing a needle in its rest position, in which the distal end portion of the needle is immersed in a magnetic ink film formed in a slit between a pair of slit forming members of ink film forming means, and the end face of the distal end portion is in contact with the inside of the film surface of the magnetic ink film on the side of the recording medium.

Applied between the needle 44 and the electrode 80 is a voltage from a power source (not shown) which is controlled by voltage control means 96 so as to produce an electric field of a desired intensity as mentioned later. In this embodiment, the distal end face of each needle 44 is rounded, as shown in FIG. 5, in order to prevent electric discharge between the needle end face and the electrode 80.

In the ink-dot printer according to the embodiment of the invention constructed in this manner, when the power source is turned on to energize the electromagnet 60, the magnetic field control means 61 first controls the voltage applied from the power source to the electromagnet 60 so as to produce in the slit 56 an ink attracting magnetic field of an intensity required for drawing up a predetermined amount of magnetic ink from the ink tank 70 into the slit 56. The magnetic ink 74 introduced into the slit 56 forms a magnetic ink film 98 of a predetermined thickness, as shown in FIG. 5, in which are immersed distal end portions 100 of all the needles 44 (nine in number, but only one shown in FIG. 5) in the slit 56, located in a rest position. At this time, the end face of the distal end portion 100 of each needle 44 in the rest position is in contact with the inside of a film surface 102 of the magnetic ink film 98 on the side of the recording sheet 18.

Figure 6:
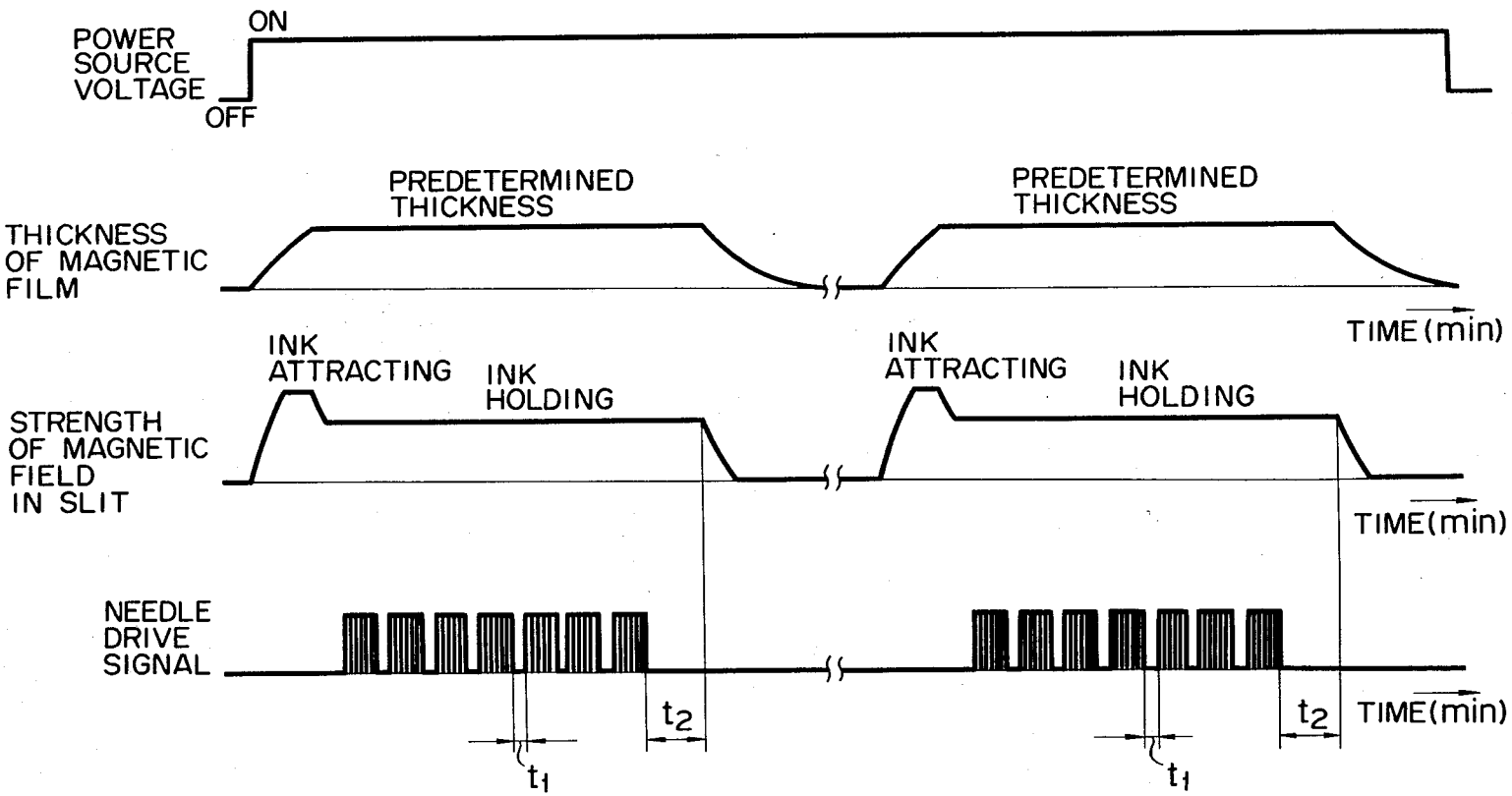
FIG. 6 shows time charts for needle driving signal, intensity of magnetic field in slit, thickness of magnetic film, and power source voltage of the ink-dot printer of FIG. 1.

When the magnetic ink film 98 of the predetermined thickness is formed in the slit 56 between the two slit forming members 58 and 59 in the aforesaid manner, the magnetic field control means 61 controls the voltage supplied to the electromagnet 60 so as to produce an ink holding magnetic field of a minimum intensity required for holding in the slit 56 the magnetic ink film 98 of the predetermined thickness (or the aforesaid predetermined amount of magnetic ink 74), as shown in FIG. 6. The strength of this ink holding magnetic field is smaller than that of the aforesaid ink attracting magnetic field. Therefore, power consumption per unit time required for the production of the ink holding magnetic field is less than that for the production of the ink attracting magnetic field.

Figure 7:
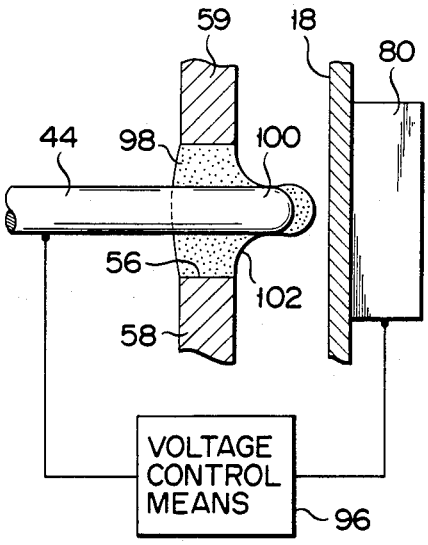
FIG. 7 is a sectional plan view similar to FIG. 5 schematically showing the needle in its projected position, in which the distal end portion of the needle is located closer to the recording medium than in the rest position, projected from the film surface of the magnetic ink film on the recording medium side.

The moment the electromagnet 60 of the ink film forming means 54 starts to be energized, the voltage control means 96 applies a base voltage between the needle 44 and the electrode 80 to produce a base electric field between them. In this embodiment, the base voltage keeps on being applied while the needle 44 is moving between the rest position as shown in FIG. 5 and a projected position where the distal end portion 100 of the needle 44 is located closer to the recording sheet 18 than in the rest position, projected from the sheet-side film surface 102 of the magnetic ink film 98, as shown in FIG. 7. Whether the needle 44 is located in the rest position or the projected position, the magnetic ink cannot be drawn from the end face of the distal end portion 100 of the needle 44 to the electrode 80 (or the recording sheet 18). However, the base voltage urges the magnetic ink to attach to the end face of the distal end portion 100 of the needle 44. Therefore, even if the same needle 44 is repeatedly driven a number of times, it is not feared that the amount of magnetic ink attaching to the end face of the free end portion 100 of the needle 44 will become insufficient to render ink dots on the recording sheet 18 blurred or reduced in diameter.

When the magnetic ink film 98 of the aforesaid predetermined thickness is formed in the slit 56, the needle driving control means (not shown) delivers a needle drive signal to move the needle 44 from the rest position shown in FIG. 5 toward the projected position shown in FIG. 7. In this embodiment, the voltage control means 96 superimposes a supplemental voltage on the base voltage to enhance the voltage applied between the needle 44 and the electrode 80 so as to produce an enhanced electric field when the needle 44 starts to move from the projected position toward the rest position after having once reached the projected position. The enhanced electric field generated between the needle 44 and the electrode 80 by the enhanced voltage has an intensity such that the magnetic ink can be flown from the distal end portion 100 of the needle 44 to the electrode 80 (or the recording sheet 18) as the needle 44 moves from the rest position to approach the electrode 80. The enhanced voltage will hereinafter be referred to as ink flying voltage, and the enhanced electric field produced by the ink flying voltage as ink flying electric field.

When the needle 44 starts to move from the projected position to the rest position, a predetermined amount of ink attaching to the distal end portion 100 of the needle 44 is separated therefrom by the force of inertia which is produced by the movement of the needle 44 from the rest position to the projected position. The magnetic ink separated from the distal end portion 100 of the needle 44 is drawn to the electrode 80 (or the recording sheet 18) by the ink flying electric field, forming an ink dot of a predetermined size.

When a predetermined time $t_2$ has passed after the movement of the needle 4 is stopped (i.e., when the printing operation is stopped), the magnetic field control mean 61 stops the power supply from the power source (not shown) to the electromagnet 60. As a result, the slit forming members 58 and 59 cease to produce the magnetic field in the slit 56, so that the magnetic ink in the slit 56 returns to the ink tank 70 by gravity.

The predetermined time $t_2$ is much longer than a time $t_1$ required for stopping the movement of the needle 44 for a new character or line or page break. In this embodiment, the time $t_2$ is 10 minutes.

According to the present embodiment, moreover, the magnetic ink in the slit 56 returns to the ink tank 70 in the aforesaid manner unless the movement of the needle 44 (i.e., printing operation) is started within the time $t_2$ after the power is turned on.

If the power source is on, the magnetic field control means 61, which is stopping the power supply to the electromagnet 60 to feed back the magnetic ink from the slit 56 into the ink tank 70 after the lapse of the predetermined nonprinting time $T_2$, controls the voltage supplied from the power source to the electromagnet 60 so that the ink attracting magnetic field is produced in the slit 56 as a printing signal for the next cycle is supplied from a host computer (not shown) to the needle driving control means (not shown). After the magnetic ink film 98 of the predetermined thickness is formed in the slit 56, the magnetic field control means 61 controls the voltage supplied from the power source to the electromagnet 60 so that the ink holding magnetic field is produced in the slit 56 in the aforesaid manner. After the ink holding magnetic field is produced in the slit 56 by the magnetic field control means 61, the needle driving control means supplies the needle driving means 30 with the needle driving signal responsive to the printing signal, thereby driving needle 44 for printing.

FIG. 6 shows time charts for the power source voltage, thickness of magnetic film, intensity of magnetic field in slit, and needle driving signal.

Figure 8:
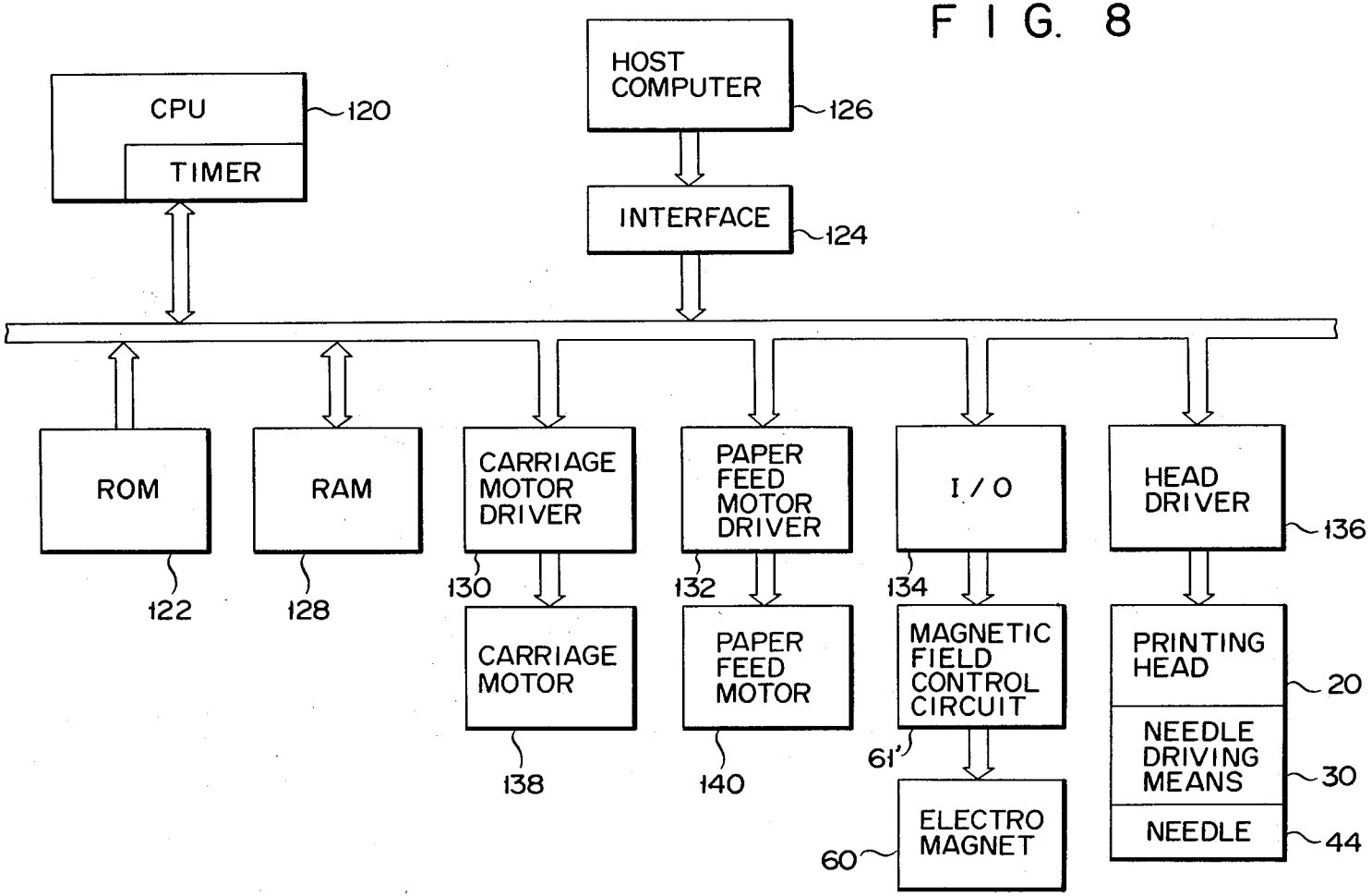
FIG. 8 is a diagram schematically showing a control circuit of the ink-dot printer of FIG. 1.

Referring now to FIG. 8, a control circuit of the ink-dot printer according to the above-mentioned embodiment will be described in brief. The control circuit comprises a central processing unit (CPU) 120 provided with a timer, a read-only memory (ROM) 122 storing programs to be executed by the CPU 120 and character data, and a random access memory (RAM) 128 for temporarily storing control data transmitted from a host computer 126 through an interface 124 or printing control data obtained during program execution.

The CPU 120 is coupled with a carriage motor 138, a paper feed motor 140, a magnetic field control circuit 61' for the magnetic field control means 61, and the printing head 20 with the needle driving means 30 and the needles 44 through a carriage motor driver 130, a paper feed motor driver 132, an I/O port 134, and a head driver 136, respectively. The magnetic field control circuit 61' is coupled to the electromagnet 60.

Figure 9:
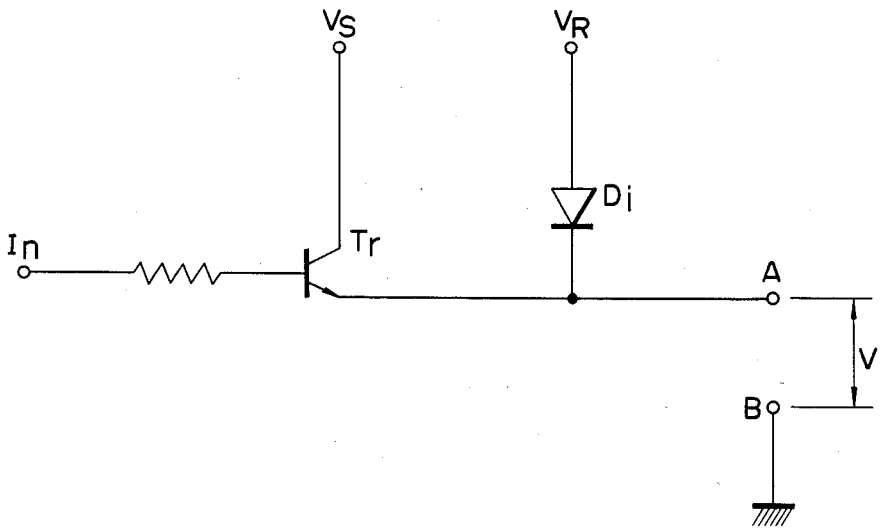
FIG. 9 is a diagram schematically showing a magnetic field control circuit included in the control circuit of FIG. 8.

FIG. 9 shows the magnetic field control circuit 61' for the magnetic field control means 61 used in the above described embodiment of the present invention.

In FIG. 9, one terminal $V_S$ of the power source for producing the ink attracting magnetic field is connected to the collector of the transistor $T_r$, the emitter of which is connected to one terminal A for the electromagnet 60. One terminal $V_R$ of the power source for producing the ink holding magnetic field is connected to the terminal A through a diode $D_i$. The base of the transistor $T_r$ is connected to a terminal $I_n$ for a base power source through a resistor. The other terminal B for the electromagnetic 60 is grounded. It goes without saying that the voltage applied to the terminal $V_R$ for the ink holding magnetic field is lower than the voltage applied to the terminal $V_S$ for the ink attracting magnetic field.

In the magnetic field control circuit 61', when a base voltage applied to the base terminal of the transistor $T_r$ becomes high, an ink attracting voltage to make the electromagnet 60 produce the ink attracting magnetic field is applied between the two terminals A and B for the electromagnet 60 through the ink attracting power source terminal $V_S$. When the base voltage applied to the base terminal of the transistor $T_r$ becomes low, on the other hand, an ink holding voltage to make the electromagnet 60 produce the ink holding magnetic field is applied between the terminals A and B through the ink holding power source terminal $V_R$.

Figure 10:
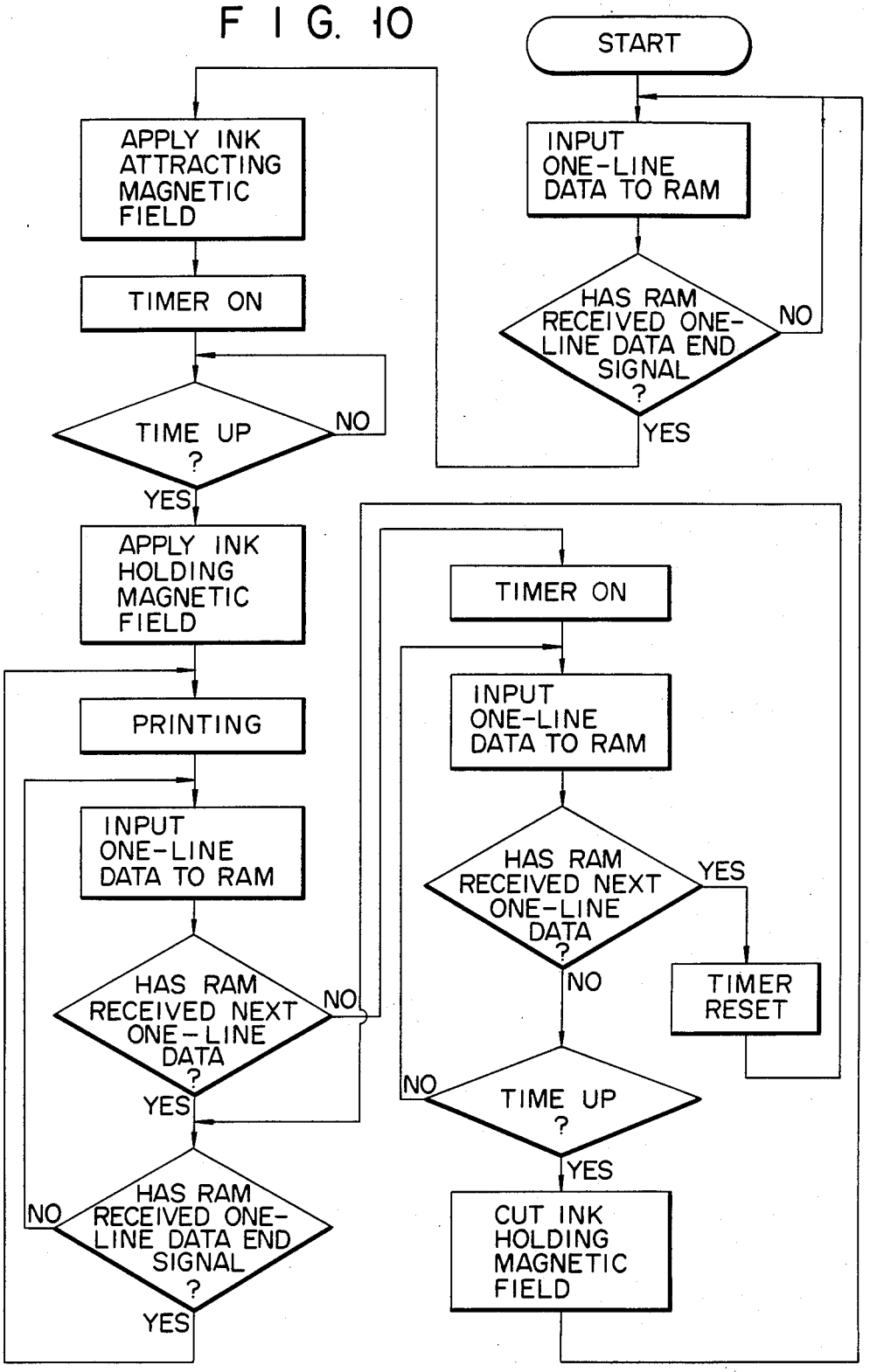
FIG. 10 is a flow chart for illustrating operations of the control circuit of FIG. 8.

Referring now to FIG. 10, the operation of the control circuit of FIG. 8 will be described.

First, printing data for one line is inputted from the host computer 126 to the buffer of the RAM 128 through the interface 124. When a one-line data end signal is supplied from the host computer 126 to the buffer of the RAM 128 at the end of the printing data for one line, the magnetic force control means 61 controls the voltage applied from the power source (not shown) to the electromagnet 60 so that an ink attracting magnetic field of a necessary intensity for a predetermined amount of magnetic ink to be drawn up from the ink tank 70 into the slit 56 is generated in the slit 56.

The moment the magnetic field control means 61 starts to apply the ink attracting voltage to the electromagnet 60 in the aforesaid manner, the timer of the CPU 120 is switched on to measure the predetermined time interval which elapses from the instant that the aforesaid predetermined amount of magnetic ink is drawn from the ink tank 70 into the slit 56 until the magnetic ink film 98 of the predetermined thickness is formed in the slit 56. After the lapse of the aforesaid predetermined time, the magnetic field control means 61 controls the voltage supplied from the power source to the electromagnet 60 so that an ink holding magnetic field of a minimum necessary intensity for the predetermined amount of magnetic ink to be held in the slit 56 is generated in the slit 56.

The moment the magnetic field control means 61 starts to apply the ink holding voltage in the aforesaid manner, the RAM 128 supplies a printed signal to the needle driving control means to cause it to supply the needle driving means 30 of the printing head 20 with a needle driving signal responsive to the printing signal. In response to the needle driving signal, the needle driving means 30 moves the selected at least one needle 44 between the rest position and the projected position with the carriage 16 moving in one direction for a printing for one line on the recording sheet 18.

When the printing for one line is completed, printing data for the next one line is intended to input from the host computer 126 to the buffer of the RAM 128. If the one-line data end signal is supplied to the RAM 128 following the printing data for the next one line, the aforesaid printing operation for one line is performed again.

If the buffer of the RAM 128 is disabled from receiving the printing data for the next one line, the timer of the CPU 120 is switched on again. While the timer is determining the lapse of the predetermined time (10 minutes in this embodiment), the printing data for the next one line keeps on being intended to input from the host computer 126 to the buffer of the RAM 128. If the buffer of the RAM 128 receives the next one-line data from the host computer 126 before the lapse of the predetermined time, the timer is reset, and the one-line data end signal is supplied to the RAM 128 at the end of the printing data for the next one line. Thus, the printing operation is repeated for the next one line.

If the buffer of the RAM 128 does not receive the printing data for the next one line before the lapse of the aforesaid predetermined time, the magnetic field control means 61 stops the supply of the ink holding voltage to the electromagnet 60, thereby causing the magnetic ink in the slit 56 to return to the ink tank 70. Then, the operation may be restarted.

It is to be understood that the present invention is not limited to the embodiment described above, and that various changes and modifications may be effected therein by one skilled in the art without departing from the scope or spirit of the invention.

For example, the ink attracting means may be designed so as to attract the ink from the ink storage means into the slit between the two slit forming members by producing an electric force in the slit. In this case, magnetic ink having no electric conductivity may be used.

Further, according to the aspect of this invention, needle reaching the projected position may strike the recording medium to form an ink dot on the recording medium.

What is claimed is:

1: An ink-dot printer comprising:

a pair of slit forming members arranged so as to define a slit therebetween;

ink storage means for storing ink so that the slit between the two slit forming members is immersed in the ink;

a recording medium opposed to the slit;

a needle movable between a rest postition in which the distal end portion of the needle facing the recording medium is located in the slit and a projected position in which said distal end portion of the neele is projected from the slit so as to be located closer to the recording medium than when it is in the rest position;

driving means for moving the needle between the rest position and the projected position;

ink attracting means for generating a magnetic or electric field in the slit between the two slit forming ember for thereby attracting ink from the ink storage means into the slit to cause the attracted ink to attach to the distal end portion of the needle located in the rest position;

said ink attracting means including an electromagnet connected to the pair of slit forming members for generating a magnetic field in the slit; and control means for electrically controlling said ink attracting means to cause it to generate a field to produce an ink attracting magnetic or electric force of sufficient intensity to attract ink from the ink storage means into the slit at the time of ink attraction, and for further electrically controlling said ink attracting means to cause it to generate a lower intensity field to produce an ink holding magnetic or electric force which is of lower intensity than said attracting magnetic or electric force, said ink holding magnetic or electric force being of a sufficient intensity to hold a predetermined amount of ink in the slit after the predetermined amount of ink is attracted into the slit;

said control means including a timer for setting the length of the ink attracting magnetic or electric force generating time;

wherein the ink attaching to the distal end portion of the needle at the rest position is moved to the recording medium to form an ink dot thereon as the needle moves to approach the recording medium in a projected position.

2. The ink-dot printer according to claim 1, wherein said ink attracting means includes means for ceasing generating of the magnetic or electric field in the slit between the two slit forming members to return the ink in the slit to the ink storage means after the lapse of a predetermined nonprinting time.

3. The ink-dot printer according to claim 1, wherein said timer starts the generation of the ink attracting magnetic or electric force in response to the inputting of printing data.

* * * * *